US007670109B2

(12) United States Patent
Greim et al.

(10) Patent No.: US 7,670,109 B2
(45) Date of Patent: Mar. 2, 2010

(54) TURBINE

(75) Inventors: Ralf Greim, Birmenstorf (CH); Said Havakechian, Baden (CH)

(73) Assignee: ALSTOM Technology Ltd., Baden (CH)

( * ) Notice: Subject to any disclaimer, the term of this patent is extended or adjusted under 35 U.S.C. 154(b) by 0 days.

(21) Appl. No.: 11/743,211

(22) Filed: May 2, 2007

(65) Prior Publication Data

US 2007/0207032 A1 Sep. 6, 2007

Related U.S. Application Data

(63) Continuation of application No. PCT/EP2005/055587, filed on Oct. 26, 2005.

(30) Foreign Application Priority Data

Nov. 2, 2004 (CH) ..... 01807/04

(51) Int. Cl.
*F01D 1/04* (2006.01)
*F01D 1/06* (2006.01)

(52) U.S. Cl. ..... 415/177; 415/199.5; 415/200; 416/201 R; 416/203; 416/241 B; 29/889.2; 60/772; 60/805

(58) Field of Classification Search ..... 415/1, 415/99–103, 120, 176–178, 198.1, 199.1–199.6, 415/200; 416/175, 183, 203, 198 A, 201 R, 416/241 R, 241 B; 60/772, 805; 29/889.2, 29/889.21, 889.22
See application file for complete search history.

(56) References Cited

U.S. PATENT DOCUMENTS 2,296,023 A * 9/1942 Dallenbach et al. ..... 415/199.5
2,848,190 A * 8/1958 Barr ..... 416/97 R
3,010,281 A 11/1961 Cervenka et al.
3,065,954 A * 11/1962 Whitaker ..... 416/183
3,143,103 A * 8/1964 Zuhn ..... 415/199.1
3,941,499 A * 3/1976 Kronogard ..... 415/199.2
4,125,344 A * 11/1978 Tiefenbacher ..... 416/183
4,571,935 A 2/1986 Rice (Continued)

FOREIGN PATENT DOCUMENTS

DE 1030358 5/1958

(Continued)

OTHER PUBLICATIONS

Abstract only of Japanese Patent 11257007, published Sep. 1999.*

(Continued)

*Primary Examiner*—Christopher Verdier
(74) *Attorney, Agent, or Firm*—Cermak Kenealy Vaidya & Nakajima LLP; Adam J. Cermak

(57) ABSTRACT

A turbine (100) of a turbine installation, especially a steam turbine of a steam turbine installation, includes at least one radial or diagonal turbine stage (120) with radial or diagonal inflow and axial outflow, and also at least one axial turbine stage (121-125) with axial inflow and axial outflow. The at least one radial or diagonal turbine stage (120) forms the first stage of the turbine (100) and the at least one axial turbine stage (121-125) is arranged downstream of the radial or diagonal turbine stage (121) as an additional stage of the turbine. The at least one radial or diagonal turbine stage (120) has a higher temperature resistance than the at least one axial turbine stage (121-125). The turbine (100) makes it possible to significantly increase the process temperature of the steam turbine installation, wherein measures for increasing the temperature resistance need only to be adopted for components of the radial or diagonal turbine stage (120).

17 Claims, 4 Drawing Sheets

U.S. PATENT DOCUMENTS

| | | | |
|---|---|---|---|
| 5,253,472 | A | 10/1993 | Dev |
| 5,385,446 | A | 1/1995 | Hays |
| 6,182,439 | B1 | 2/2001 | Siga et al. |
| 2002/0189229 | A1 | 12/2002 | Hidaka et al. |

FOREIGN PATENT DOCUMENTS

| | | |
|---|---|---|
| DE | 2345637 | 3/1975 |
| WO | WO2004/029432 | 4/2004 |
| WO | WO2006/048401 | 5/2006 |

OTHER PUBLICATIONS

"Dubbels Taschenbuch fur den Maschinenbau," 1961, Springer-Verlag, XP002314516, pp. 391-392, Berlin/Gottingen/Heidelberg, Germany.

Mowill, J., et al., "An Advanced Radial-Component Industrial Turbine Engine," J. Eng. for Power, Am. Soc. of Mech. Eng., 1983, pp. 947-952, vol. 105, XP000645507, U.S.

Dubbel, "Pocket Book for Mechanical Engineering," 1995, pp. R22, 18th Ed., Springer-Verlag, Berlin/Gottingen/ Heidelberg, Germany.

Gruenling, H.W., "Werkstoffe fuer Fortschrittliche Kraftwerke," BWK Brennstoff Warme Kraft, 1999, pp. 90-95, XP000830498, Bd. 51, No. 5/6, VDI Verlag GmbH, Dusseldorf, Germany.

Search Report for Swiss Patent App. No. 01807/04 (Feb. 8, 2005).

International Search Report for PCT Patent App. No. PCT/EP2005/055587 (Jan. 18, 2006).

* cited by examiner

TURBINE

This application is a Continuation of, and claims priority under 35 U.S.C. § 120 to, International Application Number PCT/EP2005/055587, filed 26 Oct. 2005, and claims priority therethrough to Swiss application number 1807/04, filed 2 Nov. 2004, the entireties of both of which are incorporated by reference herein.

BACKGROUND

1. Field of Endeavor

The invention relates to a turbine of a turbine installation, especially a steam turbine of a steam turbine installation. In addition, the invention relates to a method for the design of a turbine, and also a method for operating a turbine installation which is equipped with such a turbine.

2. Brief Description of the Related Art

On account of the continuing efforts towards improvement of the efficiency of modern turbine installations, especially modern steam turbine installations, it appears desirable to increase the process temperature of the turbine installations. An increase of the process temperature especially has an effect on the high-pressure turbine, on the one hand, and, on the other hand, also on the medium-pressure turbine of the turbine installation, which consequently are exposed to higher temperatures. This leads to temperatures being already achieved today also in steam turbines in which a use of conventional materials, especially for the blading of the turbine, for the flow passage walls and also for the turbine shaft, is no longer possible without temperature reduction measures.

Such a temperature reduction measure, for example, can be to cool the blades of the turbine by means of a cooling fluid. Cooling of blades in gas turbines has already been known for a long time. However, for this purpose, on one hand a cooling fluid is to be made available in a suitable manner, be it by means of an external supply or by means of a bleed from one of the compressor stages of the turbine installation. This leads to a deterioration of the overall efficiency of the turbine installation. Aerodynamic losses are also caused in the case of a film cooling or an effusion cooling of the blades by means of admission of cooling fluid into the main flow of the turbine.

Alternatively, the blades, and partially also the shafts of the turbine, can be produced from high heat-resistant materials, as a result of which, however, the turbine becomes very expensive in production.

In addition to the increase of the process temperature, for the most part, an increase of the process pressure is also sought. By means of the increase of the process parameters there occurs, especially inside the first turbine stages of a high-pressure turbine, only comparatively small volumetric flows of the throughflow fluid which flows through the turbine, mostly air or exhaust gas in gas turbines, as the case may be, or steam in steam turbines.

Small volumetric flows in turn require small blade heights of the turbine blades with small blade aspect ratios. As a result of this, it is often very difficult to design such turbine bladings with a good aerodynamic efficiency.

SUMMARY

One of numerous aspects of the present invention includes a turbine of the aforementioned type which, and a method for the design of a turbine, by which the disadvantages of the prior art are reduced or avoided.

Another aspect of the present invention includes contributing towards increasing the efficiency of a turbine of a turbine installation, especially a steam turbine of a steam turbine installation. According to a further aspect, a cost-effectively producible and efficiency-optimized turbine can be made available, which turbine is exposable to a high inlet temperature.

A turbine which is formed to embody principles of the present invention includes at least one radial or diagonal turbine stage with a radial or diagonal inflow, as the case may be, and an axial outflow. Axial outflow is also understood to be an outflow in which the flow during exit from the blade wheel of the relevant turbine stage still has, in fact, a diagonal flow direction, in which the flow, however, is then deflected from the flow passage into the axial direction before the flow reaches a subsequent turbine stage. Furthermore, the turbine which is formed according to the invention includes at least one axial turbine stage with an axial inflow and an axial outflow.

Each turbine stage has at least one blade wheel. A turbine stage customarily includes a guide wheel and a blade wheel which is arranged downstream of the guide wheel in the flow direction.

The inflow and outflow directions within the scope of the invention can also deviate in each case by a tolerance angle from the radial or diagonal direction, as the case may be, and from the axial direction, wherein, however, the principal flow direction is maintained as such.

The at least one radial or diagonal turbine stage is arranged as the first stage of the turbine, and the at least one axial turbine stage is arranged downstream of the least one radial or diagonal turbine stage as an additional stage of the turbine. The at least one radial or diagonal turbine stage in this case is formed so that it has a higher temperature resistance than the at least one axial turbine stage.

The turbine according to the invention is preferably formed as a high-pressure turbine which is arranged in a turbine installation directly downstream of a combustion chamber or a steam generator of the turbine installation. The turbine which is formed according to the invention, however, can also be formed as a medium-pressure turbine or also as a low-pressure turbine, wherein an intermediate heater is then customarily arranged upstream of the medium-pressure turbine or the low-pressure turbine. One or more additional turbines, which are formed in a conventional manner, can be arranged downstream of the turbine which is formed according to the invention.

Since the radial or diagonal turbine stage which is formed as the first stage of the turbine has a higher temperature resistance than the at least one axial turbine stage, the maximum process temperature which is present at the inlet into the turbine during nominal operation of the turbine installation can be higher than that which might be the case if the axial turbine stage were to form the inlet turbine stage. The radial or diagonal turbine stage of the turbine which is constructed according to the invention is in the position to bring about a high enthalpy conversion with the result that the temperature of the throughflow fluid at the outlet from the radial or diagonal turbine stage is appreciably lower than at the inlet into the radial or diagonal turbine stage. By only one radial or diagonal turbine stage, therefore, it is possible to lower the temperature of the throughflow fluid to a point where downstream of the radial or diagonal turbine stage no measures for increasing the temperature resistance of the components of the turbine, especially the blades, need to be adopted any longer in order to ensure that a maximum permissible material temperature of the components of the subsequent turbine stages is not exceeded. Such a measure, for example, could be the use of high heat resistant material for the affected components, or a cooling of the components of the respective turbine stage by a cooling fluid. By the arrangement of the radial or diagonal turbine stage as the first stage of the turbine, one or more measures need to be adopted only for the radial or diagonal turbine stage in order to increase the temperature resistance in this case.

Should the turbine, however, include only axial turbine stages according to a conventional construction, then in this case a plurality of axial turbine stages would be necessary in order to effect the same enthalpy conversion and, consequently, the same lowering of the temperature, as this is effected by the only one radial or diagonal turbine stage. As a consequence, suitable measures would also be adopted for this plurality of axial turbine stages in order to increase the temperature resistance of these axial turbine stages in order to thus prevent a maximum permissible material temperature being exceeded. A turbine, which includes only axial turbine stages, therefore, is significantly more expensive in production when using high heat resistant materials. If the affected components are cooled by a cooling fluid, then, on the one hand, cooling passages are to be provided in the components. On the other hand, the efficiency of the turbine is impaired as a result of this.

Especially in steam turbines, a construction of the first turbine stage as a radial or diagonal turbine stage also proves to be advantageous for the following reasons. The constant increase of the process pressure leads to small volumetric flows of the throughflow fluid. In the case of small volumetric flows, however, the efficiency of a radial or diagonal turbine stage which is suitable for this small volumetric flow is comparable to the axial turbine stages which are suitable for this small volumetric flow. In an overall efficiency balance, the turbine which is constructed according to the invention, therefore, is frequently equally as good as, or even better than, a turbine which includes only axial turbine stages.

In the case of especially high inlet temperatures of the throughflow fluid, it can also be expedient to connect in series two, or possibly even more, radial or diagonal turbine stages at the inlet into the turbine. A plurality of radial or diagonal turbine stages, however, lead again to an increase of the production costs. As a result of this, the flow path also becomes constructionally more costly so that a solution with only one radial or diagonal turbine stage is to be preferred. In the case of very high inlet temperatures, radial turbine stages are basically to be preferred to diagonal turbine stages, since radial turbine stages once more enable a higher energy conversion in comparison to diagonal turbine stages.

The turbine which is formed according to the invention especially advantageously includes just one radial or diagonal turbine stage and at least one axial turbine stage.

Even if, within the scope of the present invention, the turbine stage is simplistically only spoken off as a whole, then those components of the turbine stage which are exposed directly to the hot throughflow fluid are primarily affected by high temperatures of the throughflow fluid. These are especially the blades of a turbine stage and also often the side walls of the throughflow passage, i.e., the hub and frequently also the casing wall. Accordingly, measures for increasing the temperature resistance are primarily also to be applied to these components of a turbine stage. However, it is to be observed in this connection that as a result of thermal conduction even components which are not exposed to the hot throughflow fluid can achieve very high temperatures and, therefore, measures for increasing the temperature resistance also need to be similarly adopted for these components.

Aspect of the present invention can be basically applied to turbines and turbine installations in general. However, some aspects of the invention are especially expediently applied to a steam turbine of a steam turbine installation. Steam turbine installations customarily have large dimensions, as a result of which, in the case of a conventional construction of the steam turbine, a significant demand for high heat resistant and, therefore, expensive material would arise since a plurality of axial turbine stages would have to be produced from this material. On the other hand, steam turbines in the past, as a rule, were designed and operated so that only comparatively low maximum process temperatures occur, at the same time, however, with a large volumetric flow of throughflow fluid. On account of the large volumetric flow, the use of a radial or diagonal turbine stage or a radial or diagonal turbine was again not feasible. Only by the combined increase of the process temperature and the process pressure, and the reduction of volumetric flow which results from it, does the use of a radial or diagonal turbine stage in steam turbines become feasibly possible and leads to an improvement of the overall efficiency and/or to lower production costs, and also to steam turbine installations which are more compact in dimensions.

The radial or diagonal turbine stage is expediently produced from a first material, and the at least one axial turbine stage is expediently produced from a second material. The first material has a higher temperature resistance than the second material. Thus, the radial or diagonal turbine stage can be produced, for example, from a high heat resistant nickel based alloy, while the at least one axial turbine stage can be produced, for example, from a customary and more cost-effective cast steel or a nickel chrome steel with lower heat resistance. As was already explained above, it is to be noted in this connection, however, that not all components of a turbine stage have to be always produced from the high heat resistant material. Thus, it is often sufficient to produce from a high heat resistant material only those components which are directly exposed to the hot throughflow fluid, such as the blades and the shaft of the turbine stage.

In an alternative or even additional development of the invention, the radial or diagonal turbine stage is expediently constructed with a coating of a high heat resistant material, for example a nickel based alloy. In this connection, however, it must be ensured that the base material, which is located beneath the coating and which has a lower heat resistance, is not overheated as a result of thermal conduction. If applicable, it can be necessary in this case to additionally cool this material by a cooling provision.

Alternatively, or even additionally, the radial or diagonal turbine stage is expediently produced from a ceramic material, or is constructed with a coating of a ceramic material. Ceramic materials offer the advantage that the components do not only have a higher heat resistance but that the ceramically constructed or coated components also act in a heat-insulating manner and, therefore, a reduced heat yield into the shaft, for example via the blade roots, takes place.

The at least one axial turbine stage can then be produced from a customary turbine material without a coating.

In an alternative or even additional development of the invention, the radial or diagonal turbine stage is cooled. The at least one axial turbine stage is preferably uncooled in this case.

In an advantageous development of the invention, a stage loading of the radial or diagonal turbine stage of the turbine is selected so that in a nominal operation of the turbine, the throughflow fluid at the inlet into the radial or diagonal turbine stage has a temperature which is higher than a maximum permissible softening temperature of the material of the axial turbine stage, and at the outlet of the radial or diagonal turbine stage has a temperature which is equal to or less than a maximum permissible softening temperature of the material of the axial turbine stage. Conversely, this means that the maximum process temperature of the turbine installation can be increased up to a maximum value at which the above condition is only just fulfilled. Measures for increasing the temperature resistance, therefore, are limited to the radial or diagonal turbine stage.

By an arrangement embodying principles of the present invention, of one or more radial or diagonal turbine stages at the turbine inlet, therefore, a possibility is created in a cost-effective manner to significantly increase the maximum process temperature of the turbine installation. In consideration of economical efficiency, only the comparatively cost-effective measures for increasing the temperature resistance of the radial or diagonal turbine stages oppose the increase of efficiency of the turbine installation which is achievable by this.

The turbine is expediently constructed so that a mean outlet diameter of the radial or diagonal turbine stage is equal to a mean inlet diameter of the axial turbine stage which follows the radial or diagonal turbine stage. As a result of this, the flow passage can be formed directly between the radial or diagonal turbine stage and the axial turbine stage.

In an expedient embodiment of the invention, the radial or diagonal turbine stage and the at least one axial turbine stage are arranged on a common shaft. Such a common arrangement of the turbine stages on one shaft, however, is only possible if the turbine stages are operated continuously at the same speed.

In an embodiment of the invention which is alternative to this, the radial or diagonal turbine stage is arranged on a first shaft and the at least one axial turbine stage is arranged on a second shaft, wherein the shafts are interconnected via a transmission, preferably a planetary transmission. In fact, such an arrangement of two shafts is more costly in comparison to the arrangement of only one shaft; however, different speeds of the turbine stages can be realized in this way.

Furthermore, the radial or diagonal turbine stage and the at least one axial turbine stage are preferably arranged in a common casing.

In a further aspect, the invention provides methods for the design of a turbine. An exemplary method according to the invention includes the method steps of, among others, arranging at least one axial turbine stage downstream of a radial or diagonal turbine stage, and of constructing the radial or diagonal turbine stage with a higher temperature resistance than the at least one axial turbine stage. A method according to the invention is especially suitable for the design of a turbine according to the invention described above.

According to an advantageous development of the method, a stage loading of the radial or diagonal turbine stage of the turbine is selected so that in a nominal operation of the turbine, the throughflow fluid at the inlet into the radial or diagonal turbine stage has a temperature which is higher than a maximum permissible softening temperature of the material of the axial turbine stage, and at the outlet of the radial or diagonal turbine stage has a temperature which is equal to or less than a maximum permissible softening temperature of the material of the axial turbine stage of the turbine.

In a further aspect, the invention provides a method for operating a turbine installation, wherein the turbine installation includes a steam generator and a turbine which is formed according to the invention and which is arranged downstream of the steam generator, and heat is supplied to a throughflow fluid in a combustion chamber or in a steam generator. As a result of this, the throughflow fluid is heated to a temperature which is above a maximum permissible softening temperature of the material of the axial turbine stage of the turbine. The throughflow fluid is then expanded in the radial or diagonal turbine stage of the turbine to a point where the temperature of the throughflow fluid at the outlet from the radial or diagonal turbine stage is equal to or less than the softening temperature of the material of the axial turbine stage of the turbine.

BRIEF DESCRIPTION OF THE DRAWINGS

The invention is subsequently explained in detail with reference to several exemplary embodiments which are illustrated in the figures. In the drawings.

Only the elements and components which are essential for the understanding of the invention are represented in the figures.

The exemplary embodiments which are shown are to be purely instructively understood and are to serve for a better understanding, however are not be understood as a limitation of the subject of the invention.

DETAILED DESCRIPTION OF EXEMPLARY EMBODIMENTS

Figure 1:
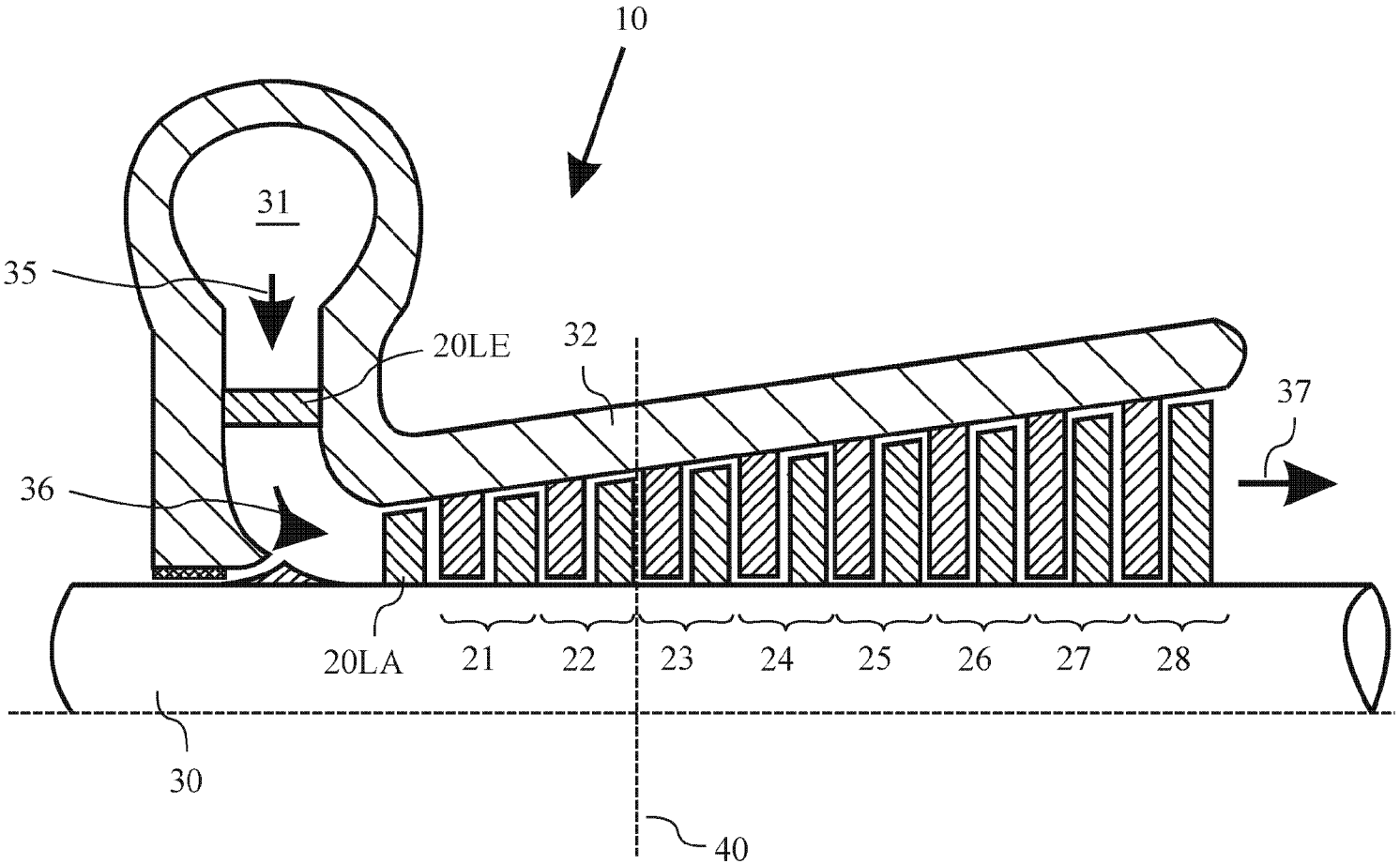
Fig. 1 (Prior Art)
FIG. 1 shows a high-pressure turbine of a steam turbine installation, which turbine is known from the prior art.

FIG. 1 shows a turbine 10 which is formed as a high-pressure turbine of a steam turbine installation, which turbine is known from the prior art. The throughflow fluid in this case is steam. The steam which comes from a steam generator (not shown in FIG. 1) is fed radially to the turbine 10 via a live steam inlet branch 31. In the radial inflow section of the live steam inlet branch 31, a first guide wheel 20LE for straightening and/or for pre-swirl generation of the steam flow is to be found here. The steam flow is then deflected in a deflecting section (in the region of the flow arrow 36) from the radial flow direction (direction of the flow arrow 35) into an axial flow direction (direction of the flow arrow 37). Only after deflection into the axial flow direction has been carried out, does the steam-flow flow through the blade wheel 20LA of the first turbine stage and, after this, also through the further axial turbine stages 21-28 of the turbine 10 which are arranged downstream of the first turbine stage. All the turbine stages 21-28, with exception of the first turbine stage 20 (=20LE+20LA), are formed as purely axial turbine stages. The first turbine stage 20 in this case is constructed as a combined radial-axial turbine stage, wherein the guide wheel 20LE is arranged in the radial inflow section of the live steam inlet branch 31, and the blade wheel 20LA is arranged in the axially flow-washed section of the turbine 10 which is formed as a high-pressure turbine. The energy conversion, therefore, is carried out exclusively in the purely axially flow-washed section. The level of energy conversion is limited to the same extent as also in axial turbine stages on account of the maximum realizable flow deflection in axially flow-washed blade wheels.

If the steam, which is fed to the steam turbine, now has a high or very high inlet temperature which is above the permissible softening temperature of the material, for example cast steel, which is customarily used for the blading of the blade wheels and guide wheels, then at least the components of those turbine stages of the turbine which form the flow passage and/or which are arranged in the flow passage, and in the region of which the steam has a temperature above the softening temperature, must be produced either from a high heat resistant material or must be cooled in a suitable manner. In the example which is shown in FIG. 1, the first three turbine stages 20, 21 and 22 of it are affected. Here, both the blades of the first three turbine stages and also the passage side walls of the flow passage are produced from a high heat resistant material. The hot zone boundary is marked by 40, upstream of which measures for increasing the temperature resistance need to be adopted. In many cases, the shaft is also to be produced from a high heat resistant material on account of thermal conduction in this region. In nominal operation of turbine 10, the steam downstream of the third turbine stage 22 first has a temperature which is below the softening temperature of the material which is customarily used for turbine components. By the use of high heat resistant material for the first three turbine stages 20, 21, and 22, the production costs for such a steam turbine significantly rise.

Figure 2:
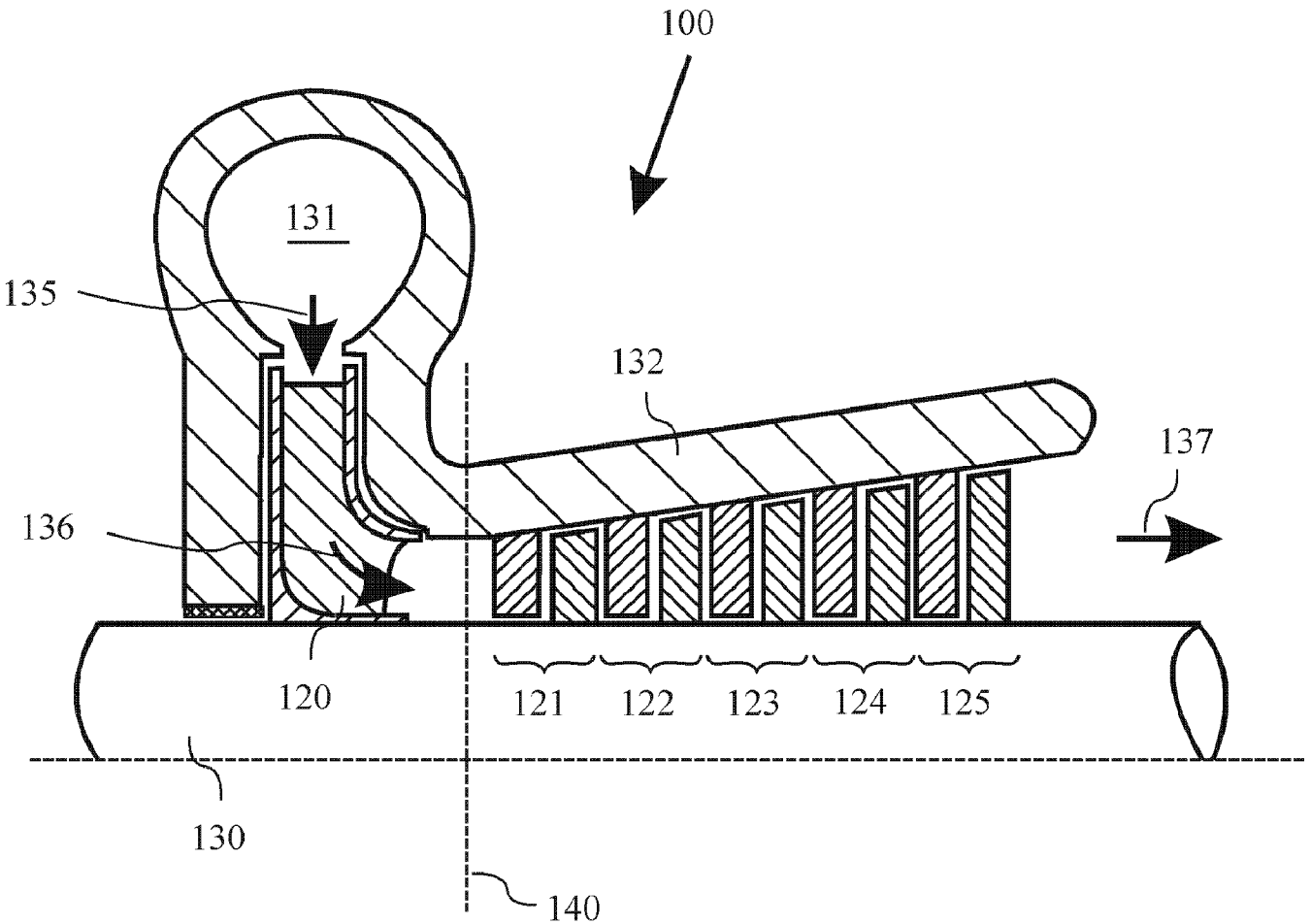
FIG. 2 shows a first turbine which is constructed according to the invention.
Figure 3:
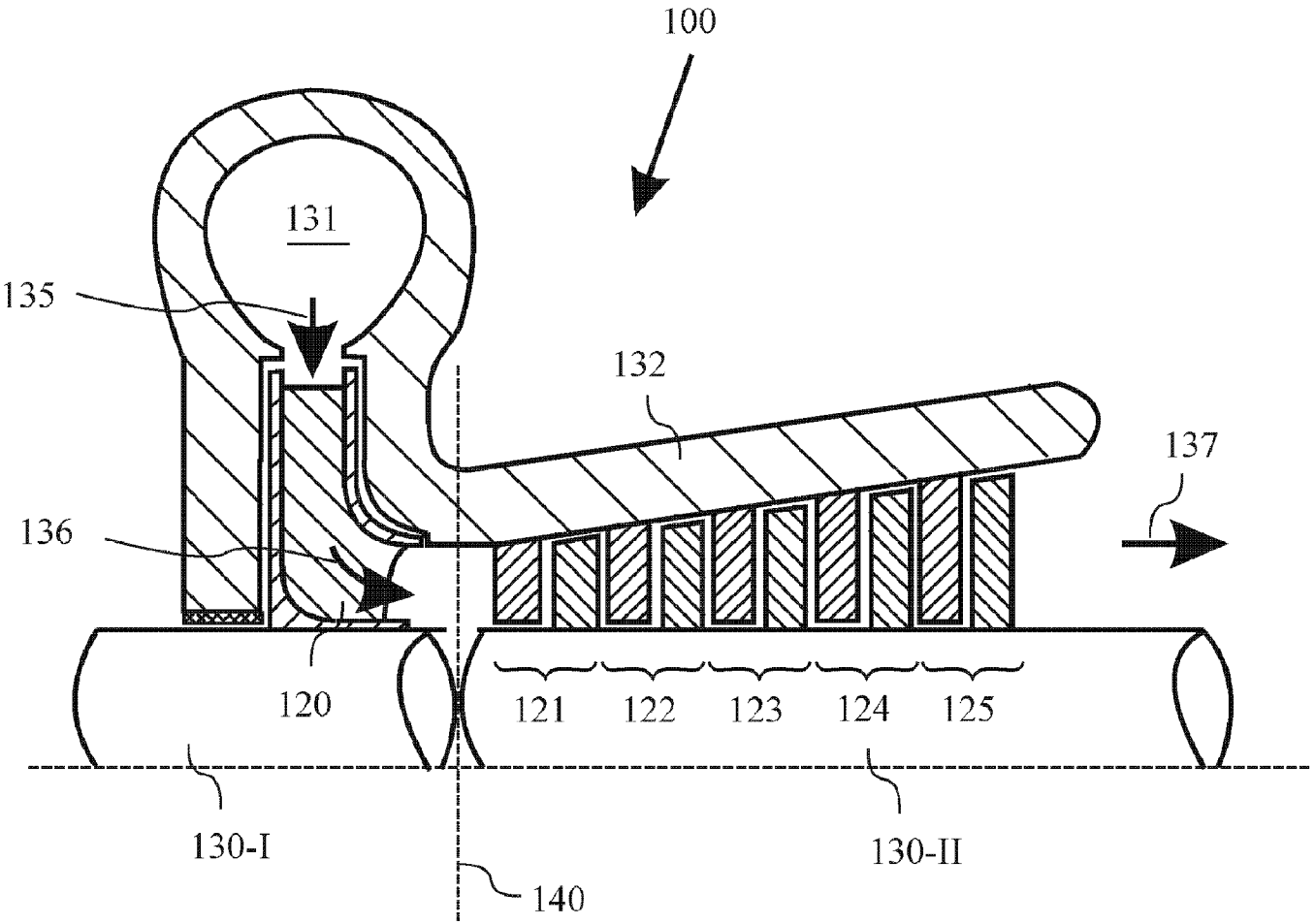
FIG. 3 shows a second turbine which is constructed according to the invention.

FIGS. 2 and 3 show turbines 100 which are formed as steam turbines and constructed according to the invention. In the two exemplary embodiments, the turbines which are shown here include, in each case, just one radial turbine stage 120 with radial inflow (direction of the flow arrow 135) and axial outflow (direction of the flow arrow 137), and also a plurality of axial turbine stages 121-125 with axial inflow and axial outflow in each case. The radial turbine stage 120 which is formed as the first stage of the turbine is connected directly to the radially extending part of a live steam inlet branch 131. The axial turbine stages 121-125 are arranged directly downstream of the radial turbine stage 120 in the two exemplary embodiments.

Figure 4:
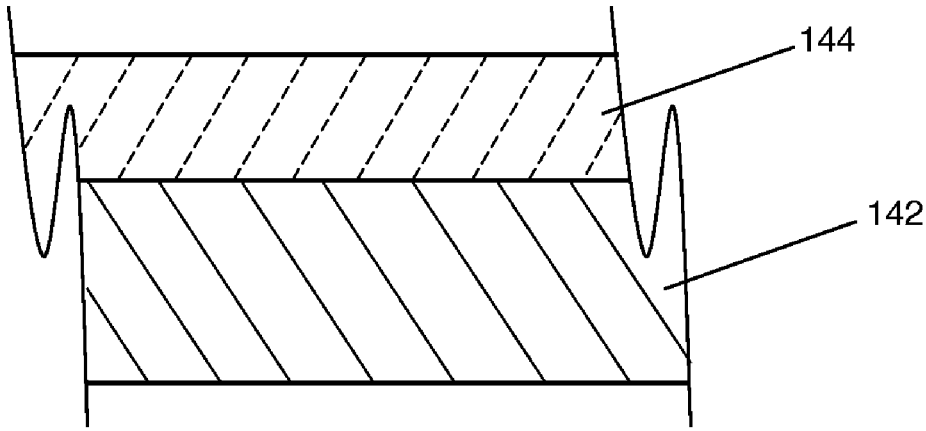
FIG. 4 illustrates a cross sectional view of a portion of a wheel having a coating.

In order to enable a charging with very hot steam, the radial turbine stages 120 which are shown in FIGS. 2 and 3 are constructed in each case with a higher temperature resistance than the axial turbine stages 121-125. This is achieved, for example, by the radial turbine stage 120 being produced in each case from a high heat resistant nickel based alloy or from a ceramic material, whereas the axial turbine stages 121-125 are produced in each case, for example, from a customary cast steel or a nickel chrome steel. Alternatively to the use of a high heat resistant material, or even additionally to it, the blades 142 of the radial turbine stage 120 could also be specially constructed either with a heat-insulating coating 144 (see FIG. 4) or with cooling.

The radial turbine stages 120 which are shown in FIGS. 2 and 3, therefore, basically geometrically replace in each case the radial-axial turbine stage 20 of FIG. 1. During the flow-washing of the radial turbine stages 120 according to FIGS. 2 and 3, however, the temperature of the steam flow is lowered to a point where the subsequent axial turbine stages 121-125 can be manufactured from conventional turbine material. Since radial and also diagonal turbine stages 120 can be loaded significantly higher and can bring about a significantly higher enthalpy conversion than axial turbine stages, only one radial turbine stage is necessary in each case in the exemplary embodiments of the invention which are shown here in order to adequately lower the temperature below the softening temperature of the material of the axial turbine stages 121-125. In the embodiment according to FIG. 1 which is known from the prior art, however, three axial turbine stages 20, 21, and 22 were necessary for an adequate lowering of the temperature. In similar conditions of the throughflow fluid at the inlet into the turbine, only the components of the respective radial turbine stage 120 need to have a high temperature resistance as a result in the embodiment of the turbine according to the invention as shown in FIGS. 2 and 3. Therefore, this affects significantly fewer components than this is the case in conventionally constructed turbines.

Since the process pressure is also increased to achieve higher efficiencies in addition to the process temperature, only comparatively small volumetric flows of the throughflow fluid are produced at the inlet into the turbines. In the case of small volumetric flows, however, radial or diagonal turbine stages have an efficiency similar to axial turbine stages. Therefore, the turbines which are shown in FIGS. 2 and 3 are also comparable in their overall efficiencies to the turbine of FIG. 1, but with appreciably lower production costs and more compact dimensions.

In the following, a method for the design of a turbine according to the invention is explained with reference to the turbine 100 which is shown in FIGS. 2 and 3. In both examples, typical geometric and other boundary conditions are assumed for high-pressure turbines which are used in steam turbine installations, i.e., a shaft diameter of about 880 mm and a nominal speed of the turbine installation of 50 Hz. For design of the blade wheel of the radial turbine stage 120, the so-called "Cordier diagram" is used (see, for example, Dubbel, "Pocket Book for Mechanical Engineering", 18th Edition, R22), which is known from the prior art, in which, for single-stage turbo-machines, a correlation between a diameter parameter $\delta_M$ is graphically represented in a function of the specific speed $\sigma_M$, wherein:

$$\delta_M=|\psi y_M|^{1/4}/|\phi_M|^{1/2}$$

and $$\sigma_M=|\phi_M|^{1/2}/|\psi y_M|^{3/4}$$

with $$\phi_M=C_m/u_m$$

and $$\psi y_M=\Delta h/(u_m^2/2)$$

As a result of this, an acceptable efficiency of the turbine stage with an isentropic efficiency of about 90% is ensured.

In the two exemplary embodiments, it is assumed that during nominal operation of the turbine, the inlet pressure at the inlet into the turbine is 300 bar and the steam mass throughflow is about 400 kg/s. These represent typical values for modern steam turbines.

If the turbine inlet temperature should now be 620° C., which is a typical value for a supercritical steam turbine which is designed in the modern style, then with the aid of the Cordier diagram the subsequently represented values result, if at the outlet from the radial turbine stage an outlet temperature of 565° C. and less should be produced:

$$\phi_M=0.30;\ \psi y_M=6.50 \Rightarrow \delta_M\approx 2.9;\ \sigma M\approx 0.14$$

At a temperature of 565° C. and less, no measures for increasing the temperature resistance need to be adopted for the components downstream of the radial turbine stage, since this temperature value is below the softening temperature of the material which is customarily used for the axial turbine stages.

The radial turbine stage 120 which is designed in this way creates a pressure drop of the steam from 300 bar at the inlet into the radial turbine stage to 217 bar at the outlet from the radial turbine stage, i.e., the pressure ratio is at about 1.4. The temperature at the outlet from the radial turbine stage is at about 560° C. The speed of the radial turbine stage is at 50 Hz, with a mean diameter of $D_M$ 1120 mm, and a blade width of 23 mm at the inlet and 41 mm at the outlet.

The guide wheel of the first axial turbine stage 121, which guide wheel is arranged downstream of the radial turbine stage 120, can then operate with a typical axial inflow and a blade height of about 60 mm, with an assumed throughflow coefficient of about 0.24. For this purpose, the guide wheel of the first axial turbine stage 121 has a mean inlet diameter which is equal to the mean outlet diameter of the blade wheel of the radial turbine stage 120. Therefore, a straight throughflow passage can be realized in the region of the transition from the radial turbine stage 120 to the axial turbine stage 121.

As was explained in the preceding exemplary embodiment, it is possible to design a radial or diagonal turbine stage so that the latter, at a typical nominal operating state of a steam turbine in which the steam turbine is charged with steam at a high or very high inlet temperature, operates with good efficiency. The turbine stage which is designed in this way then ensures in operation that the axial turbine stages which are arranged downstream are exposed only to customary, far lower temperature loads, even if the inlet temperature at the inlet into the radial or diagonal turbine stage is appreciably above a permissible softening temperature of the material of the axial turbine stages.

In addition, in the exemplary embodiment according to FIG. 2, the radial turbine stage 120 can be operated at the same speed as the axial turbine stages 121-125. As a result of this, it is possible to arrange the radial turbine stage 120 and the axial turbine stages 121-125, as shown in FIG. 2, on a common shaft 130. A continuous, common casing 132 can also be used in this case.

In the exemplary embodiment which is shown in FIG. 3, an inlet temperature of 700° C. into the turbine 100, which is constructed as a steam turbine, is assumed. This represents a typical value for ultra-supercritical turbines. A temperature of 565° C. or less is again required at the outlet from the radial turbine stage 120. With the aid of the Cordier diagram, the following parameters result from these requirements:

$$\phi_M=0.30;\psi y_M=4.00=>\delta_M 2.6;\sigma_M 0.19$$

The radial turbine stage 120 which is designed in this way creates a pressure drop of the steam flow from 300 bar at the inlet into the radial turbine stage to 145 bar at the outlet from the radial turbine stage, i.e., the pressure ratio is at about 2.1. The temperature at the outlet from the radial turbine stage 120 is at about 565° C. The speed of the radial turbine stage 120 is 100 Hz, with a mean diameter of $D_{M\sim}$1120 mm, and a blade width of 13 mm at the inlet and 32 mm at the outlet.

The guide wheel of the first axial turbine stage 121 which is arranged downstream of the radial turbine stage 120, with a typical axial inflow and a blade height of about 100 mm, can then operate with an assumed throughflow coefficient of about 0.22. The guide wheel of the first axial turbine stage 121 has a mean inlet diameter which is equal to the mean outlet diameter of the blade wheel of the radial turbine stage 120. Therefore, in the region of the transition from the radial turbine stage 120 to the first axial turbine stage 121, a throughflow passage which extends straight can be realized.

However, the speed of the axial turbine stages 121-125 is only 50 Hz in this case, while the speed of the radial turbine stage 120 is 100 Hz.

This exemplary embodiment shows that even in the case of a very high inlet temperature at the inlet into the turbine, starting from a typical nominal operating state of a steam turbine, it is possible to provide a radial or diagonal turbine stage as the inlet stage of the steam turbine. The radial turbine stage 120 which is designed in this way and which operates with good efficiency, then ensures in operation that the axial turbine stages 121-125, which are arranged downstream, are exposed only to appreciably lower temperature loads, even if the inlet temperature at the inlet into the radial turbine stage 120 is very appreciably above a permissible softening temperature of the material of the axial turbine stages 121-125. The hot zone boundary 140, upstream of which measures for increasing the temperature resistance have to be adopted, in this case extends between the radial turbine stage 120 and the first axial turbine stage 121.

However, the radial turbine stage 120 and the axial turbine stages 121-125 in this exemplary embodiment are to be operated at different speed so that it is not possible in this case to arrange the radial turbine stage 120 and the axial turbine stages 121-125 on a common shaft. The high speed of the radial turbine stage 120 results from the requirement to achieve a high temperature lowering or a high enthalpy conversion, as the case may be, in the radial turbine stage. A high temperature lowering or a high enthalpy conversion, as the case may be, is possible only if either the radial turbine stage is constructed to rotate fast, or, alternatively, the radial turbine stage has a very large diameter, or, alternatively, the blading of the turbine stage is aerodynamically very highly loaded. The last two alternatives are unsuitable in this case since a very large diameter would require very small blade widths, and a very high aerodynamic loading of the blades would result in a poor stage efficiency.

Therefore, it is expedient in this case to allow the radial turbine stage 120 to rotate faster than the axial turbine stages 121-125. As a result, the radial turbine stage 120 is arranged on one shaft section 130-I, and the axial turbine stages 121-125 are arranged on another shaft section 130-II. In this case, it is possible to accommodate the first turbine section, which includes the radial turbine stage 120, as well as the second turbine section, which includes the axial turbine stages 121-125, on separate shafts, in fact, but however, in a common casing 132 or even in two casings which are separated from each other.

The two shaft sections 130-I, 130-II, which are shown in FIG. 3, are interconnected via a transmission, which is not shown in FIG. 3. The shafts, however, can also be interconnected via a planetary transmission, wherein, for example, the shaft section 130-I upon which the radial turbine stage 120 is arranged, and the shaft section 130-II upon which the axial turbine stages 121-125 are arranged, are enclosed in the planetary transmission.

The turbines 100, which are shown in FIGS. 2 and 3, can be arranged as high-pressure turbines of steam turbine installations, wherein a steam generator is then arranged upstream of the fresh air inlet branch 131.

The steam turbines, which are shown in FIGS. 2 and 3, however, can also be arranged as medium-pressure turbines of steam turbine installations, wherein a reheater is then arranged as a rule upstream of the fresh air inlet branch.

The turbines and turbine installations, which are described in relation to FIGS. 2 and 3, and also the described method, represent exemplary embodiments of the invention which can easily be modified by a person skilled in the art in a variety of ways without any problem, without abandoning the inventive idea as a result.

List of designations

10 Turbine

20LE Guide wheel of the radial turbine stage

20LA Blade wheel of the radial turbine stage

21-28 Axial turbine stages

30 Shaft

31 Live steam inlet branch
32 Casing
35, 36, 37 Flow direction of the throughflow fluid
40 Hot zone boundary
100 Turbine
120 Radial or diagonal turbine stage
121-125 Axial turbine stages
130 Common shaft
130-I, 130-II Shaft sections
131 Live steam inlet branch
132 Casing
135, 136, 137 Flow direction of the throughflow fluid
140 Hot zone boundary
142 blade of a stage
144 heat-insulating coating While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

What is claimed is:

1. A turbine of a turbine installation, the turbine comprising:

a rotatable shaft;

a radial or diagonal turbine stage with radial or diagonal inflow and axial outflow mounted on the shaft such that the radial or diagonal turbine stage rotates with the shaft;

at least one axial turbine stage each defined as an axial stage by having axial inflow and axial outflow, and consisting of an upstream non-rotating blade wheel and a downstream blade mounted to the shaft;

wherein the radial or diagonal turbine stage is arranged as a first stage of the turbine, and each at least one axial turbine stage is arranged downstream of the radial or diagonal turbine stage as an additional stage of the turbine; and wherein the radial or diagonal turbine stage has a higher temperature resistance than each at least one axial turbine stage.

2. The turbine as claimed in claim 1, wherein:

the radial or diagonal turbine stage is formed from a high heat resistant nickel based alloy; and each axial turbine stage is formed from a material selected from the group consisting of cast steel and nickel chrome.

3. The turbine as claimed in claim 1, wherein the radial or diagonal turbine stage is formed from a ceramic material, or is coated with a coating of a ceramic material.

4. The turbine as claimed in claim 1, wherein the at least one axial turbine stage is formed from a turbine material without a coating.

5. The turbine as claimed in claim 1, wherein a stage loading of the radial or diagonal turbine stage is selected so that, in a nominal operation of the turbine, a throughflow fluid at the inlet into the radial or diagonal turbine stage has a temperature which is higher than a maximum permissible softening temperature of the material of the axial turbine stage, and the throughflow fluid at the outlet from the radial or diagonal turbine stage has a temperature which is equal to or less than a maximum permissible softening temperature of the material of the axial turbine stage.

6. The turbine as claimed in claim 1, wherein the radial or diagonal turbine stage is configured and arranged so that a temperature drop of the throughflow fluid between the inlet into the radial or diagonal turbine stage and the outlet from the radial or diagonal turbine stage is at least 50° C.

7. The turbine as claimed in claim 1, wherein a mean outlet diameter of the radial or diagonal turbine stage is equal to a mean inlet diameter of an axial turbine stage of the axial turbine stage arranged subsequent to the radial or diagonal turbine stage.

8. The turbine as claimed in claim 1, wherein said rotatable shaft is a first shaft, and further comprising:

a second shaft and a transmission interconnecting the first shaft and the second shaft;

wherein the radial or diagonal turbine stage is arranged on the first shaft; and wherein the at least one axial turbine stage is arranged on the second shaft.

9. The turbine as claimed in claim 1, further comprising:

a common casing; and wherein the radial or diagonal turbine stage and the at least one axial turbine stage are arranged in the common casing.

10. A method for the construction of a turbine, the method comprising:

providing at least one axial turbine stage configured and arranged to be positioned downstream of a radial or diagonal turbine stage;

forming the radial or diagonal turbine stage to rotate as a unit on a shaft and with a higher temperature resistance than the temperature resistance of the at least one axial turbine stage; and selecting a stage loading of the radial or diagonal turbine stage so that, in a nominal operation of the turbine, a throughflow fluid at the inlet into the radial or diagonal turbine stage has a temperature which is higher than a maximum permissible softening temperature of the material of the axial turbine stage, and the throughflow fluid at the outlet from the radial or diagonal turbine stage has a temperature which is equal to or less than a maximum permissible softening temperature of the material of the axial turbine stage of the turbine.

11. The method as claimed in claim 10, further comprising:

selecting a temperature drop of the throughflow fluid between the inlet into the radial or diagonal turbine stage and the outlet from the radial or diagonal turbine stage of at least 50° C.

12. The turbine as claimed in claim 8, wherein the turbine comprises a steam turbine and the turbine installation comprises a steam turbine installation.

13. The turbine as claimed in claim 1, wherein each axial turbine stage is uncooled.

14. The turbine as claimed in claim 1, wherein the radial or diagonal turbine stage is configured and arranged so that a temperature drop of the throughflow fluid between the inlet into the radial or diagonal turbine stage and the outlet from the radial or diagonal turbine stage is more than 60° C.

15. The turbine as claimed in claim 1, wherein the radial or diagonal turbine stage is configured and arranged so that a temperature drop of the throughflow fluid between the inlet into the radial or diagonal turbine stage and the outlet from the radial or diagonal turbine stage is more than 120° C.

16. The turbine as claimed in claim 8, wherein the transmission comprises a planetary transmission.

17. The turbine installation as claimed in claim 1, wherein the turbine installation comprises a steam turbine installation.

* * * * *